US009226556B1

(12) United States Patent
Chien et al.

(10) Patent No.: US 9,226,556 B1
(45) Date of Patent: Jan. 5, 2016

(54) FOOT BASE FOR ASSISTIVE DEVICE

(71) Applicants: Li-Sheng Chien, Taipei (TW); Chien-Chang Ho, Taipei (TW)

(72) Inventors: Li-Sheng Chien, Taipei (TW); Chien-Chang Ho, Taipei (TW)

( * ) Notice: Subject to any disclaimer, the term of this patent is extended or adjusted under 35 U.S.C. 154(b) by 0 days.

(21) Appl. No.: 14/535,087

(22) Filed: Nov. 6, 2014

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01)

(58) Field of Classification Search
CPC ..... A45B 9/04; A61H 3/0288; A61H 3/0244; A61H 2003/0272
USPC ..... 135/84; 248/188.9
See application file for complete search history.

(56) References Cited

U.S. PATENT DOCUMENTS 710,074 A * 9/1902 Pratt ..... A61H 3/0288 135/84
1,348,531 A * 8/1920 Amadio ..... A61H 3/0288 135/82
2,453,742 A * 11/1948 Bowen ..... A61H 3/0288 135/77
4,510,957 A * 4/1985 Frank ..... A45B 9/04 135/79
5,794,638 A * 8/1998 Richey ..... A61H 3/02 135/65
6,601,818 B1 * 8/2003 Larsen ..... A47C 3/0255 248/158
6,883,530 B2 * 4/2005 Kawakami ..... A45B 9/04 135/82
7,588,044 B2 * 9/2009 Baker ..... A61H 3/02 135/82
7,637,274 B1 * 12/2009 Dodson ..... A61H 3/0277 135/84
8,176,927 B2 * 5/2012 Wu ..... A61H 3/02 135/65
8,596,288 B2 * 12/2013 Daily ..... A45B 7/00 135/65
2006/0219280 A1 * 10/2006 Robinson ..... A61H 3/0288 135/84
2010/0313925 A1 * 12/2010 Jiang ..... A45B 9/04 135/82

FOREIGN PATENT DOCUMENTS

TW DE 202014104052 U1 * 9/2014 ..... A61H 3/0277
TW DE 202014104918 U1 * 11/2014 ..... A45B 9/04

* cited by examiner

*Primary Examiner* — Noah Chandler Hawk
(74) *Attorney, Agent, or Firm* — WPAT, P.C.; Anthony King

(57) ABSTRACT

A foot base for assistive device includes a base body having a receiving space, a top opening and multiple foot pads; a flexible sleeve disposed in the receiving space to protrude from the base body; a support rod having a lower end received in the receiving space and provided with a stop plate, and an upper end extended through the flexible sleeve for joining with an assistive device; and a spring received in the receiving space and fitted around the flexible sleeve with two ends pressed against the stop plate and an edge of the opening. With the flexible sleeve and the spring, the support rod can conically swing relative to a centerline of the foot base, allowing the assistive device to swing forward and backward when a user shifts body gravity center during walking. The foot pads enable the foot base to provide anti-skidding, buffering and shock-absorbing effects.

9 Claims, 5 Drawing Sheets

FOOT BASE FOR ASSISTIVE DEVICE

FIELD OF THE INVENTION

The present invention relates to a foot base adapted for assembling to an assistive device.

BACKGROUND OF THE INVENTION

Assistive devices, such as walking sticks, canes, crutches, walkers and the like, are important means for assisting the aged, patients with leg problem, the disabled and climbers, hereinafter generally referred to as the user, in standing and walking stably and safely. The assistive devices are mainly used to provide the user with a support and form a supporting point to reduce the load of the user's legs. Conventionally, according to different manners of use, the assistive devices are generally classified into some different types, such as walking sticks gripped by a user with one hand and underarm crutches held between the user's armpit and ribcage. The walking stick includes a handle provided on a top thereof, and the user grips at the handle when standing or walking with the aid of the walling stick, so that force applied by the user against the handle is transmitted to the ground. The underarm crutch includes a curved pad provided on a top thereof for pressing against the user's armpit, and the user clamps the curved pad between the armpit and the ribcage while grips at a handgrip when standing or walking with the aid of the crutch, so that force applied by the user against the handgrip can be transmitted to the ground.

The conventional assistive devices, such as the walking sticks and the underarm crutches, can have a single-point or a four-point lower end. When the assistive device touches the ground, there is produced a ground reaction force. To reduce the impact of the ground reaction force on the user and to prevent the assistive device from skidding, a rubber ferrule is usually fitted onto the lower end of the assistive device. The rubber ferrule generally has a truncated conical shape or a barrel shape and provides a degree of elasticity. The elasticity of the rubber ferrule buffers the ground reaction force when the assistive device touches the ground, making the assistive device more comfortable and safer for use. Meanwhile, the rubber ferrule increases a frictional force between the lower end of the assistive device and the ground surface to thereby provide an anti-skidding effect.

The single-point assistive device has the advantages of small in volume and convenient to handle, but it provides only one supporting point when the user walks and the single-point lower end of the assistive device touches the ground. With the help of the only one supporting point, the user shifts his or her body gravity center during moving. In the course of shifting the body gravity center, the user handles the assistive device to touch the ground surface, and uses the ground-touching point as a supporting point to shift the body. The rubber ferrule has a thickness and a configuration that can only provide the assistive device with very limited swinging span and buffering effect. As a result, the assistive device just could not be smoothly and conveniently handled by the user. Further, the rubber ferrule is subject to elastic fatigue and wearing after frequent use over a long time, and therefore requires checking and replacement now and then.

On the other hand, the four-point assistive device provides four supporting points, and is therefore more stable and easier for use, compared to the single-point assistive device. A problem in using the four-point assistive device is that the user can exert force and shift his or her body gravity center only when all the four points of the lower end of the assistive device touch the ground surface, lest the user should lose balance and fall down. Further, the four-point assistive device does not swing forward and backward when the user exert force to shift the body gravity center, and is therefore not so convenient for handle in a smooth way.

SUMMARY OF THE INVENTION

A primary object of the present invention is to provide a foot base adapted for assembling to a lower end of an assistive device, so that the assistive device is stably supported on the foot base and is adapted to swing forward and backward when a user shifts his or her body gravity center during walking.

To achieve the above and other objects, the foot base provided according to the present invention includes a base body, a flexible sleeve, a support rod, and a spring. The base body has a receiving space and a plurality of foot pads attached to a bottom of the base body, and is provided on a top with an opening, which communicates with the receiving space. The flexible sleeve is disposed in the receiving space to partially upward protrude from the base body. The support rod has a lower end received in the receiving space and provided with a stop plate, and an upper end extended through the flexible sleeve for joining with an assistive device. The spring is received in the receiving space and fitted around the flexible sleeve with two opposite ends pressed against the stop plate and an edge of the opening, respectively.

The foot base further includes an all-purpose sleeve and a sleeve seat. The all-purpose sleeve and the sleeve seat are correspondingly provided with internal threads and external threads, respectively. The sleeve seat is disposed on a top of the flexible sleeve and fitted around the support rod; and the all-purpose sleeve is fitted around the lower end of the assistive device.

The sleeve seat of the foot base includes a chuck tube portion, on an outer surface of which a plurality of axially extended and circumferentially equally spaced slits and the external threads of the sleeve seat are formed. And, the all-purpose sleeve has a bore tapered from an end with the internal threads toward another opposite end. When the all-purpose sleeve is screwed onto the sleeve seat, the chuck tube portion is radially inward compressed by the all-purpose sleeve to thereby firmly clamp on the assistive device.

The base body of the foot base includes a plurality of radially outward extended prongs; and the prongs respectively have one of the foot pads attached to a bottom thereof.

In an operable embodiment, both of the prongs and the foot pads are four in number.

The foot base for assistive device according to the present invention is characterized by having the flexible sleeve, the support rod and the spring mounted in the receiving space of the base body. The support rod is extended through the flexible sleeve and the spring is fitted around the flexible sleeve. With the flexibility of the flexible sleeve and the elasticity of the spring, the support rod is allowed to conically swing relative to the centerline of the foot base, allowing the assistive device to swing forward and backward when a user's body gravity center shifts during walking. Further, with the foot pads attached to the bottom of the base body, the foot base in use also provides anti-skidding, buffering and shock-absorbing effects.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
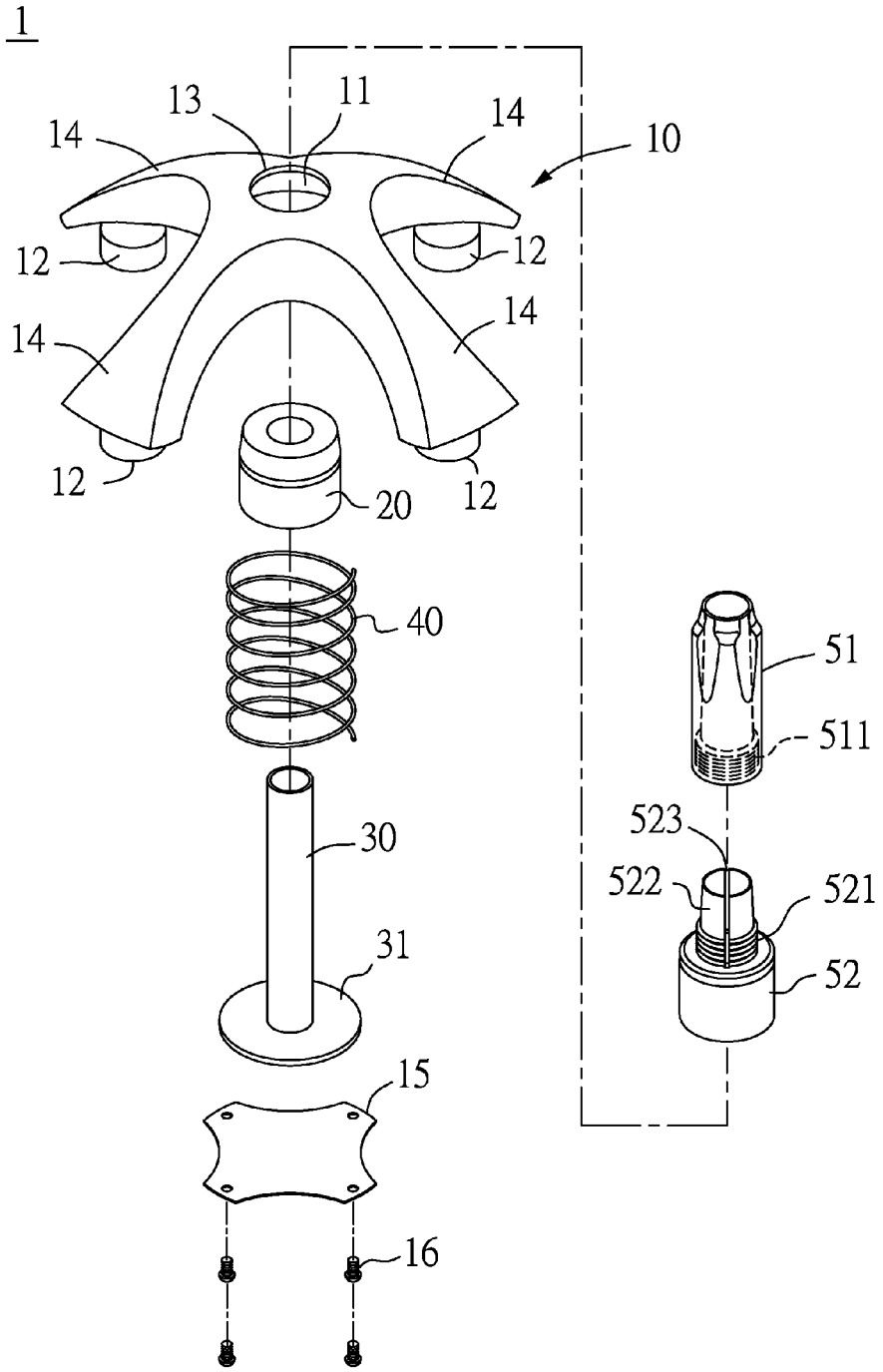
FIG. 1 is an exploded perspective view of a foot base for assistive device according to a preferred embodiment of the present invention.
Figure 2:
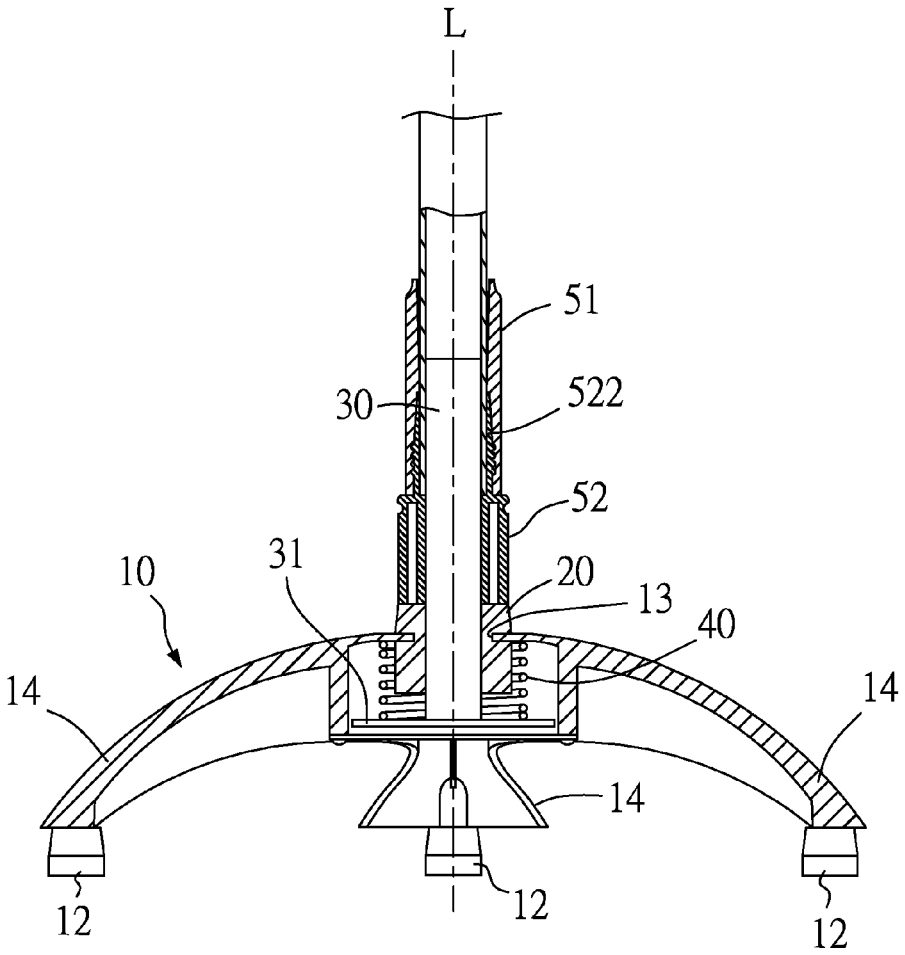
FIG. 2 is an assembled sectional view of FIG. 1.
Figure 3:
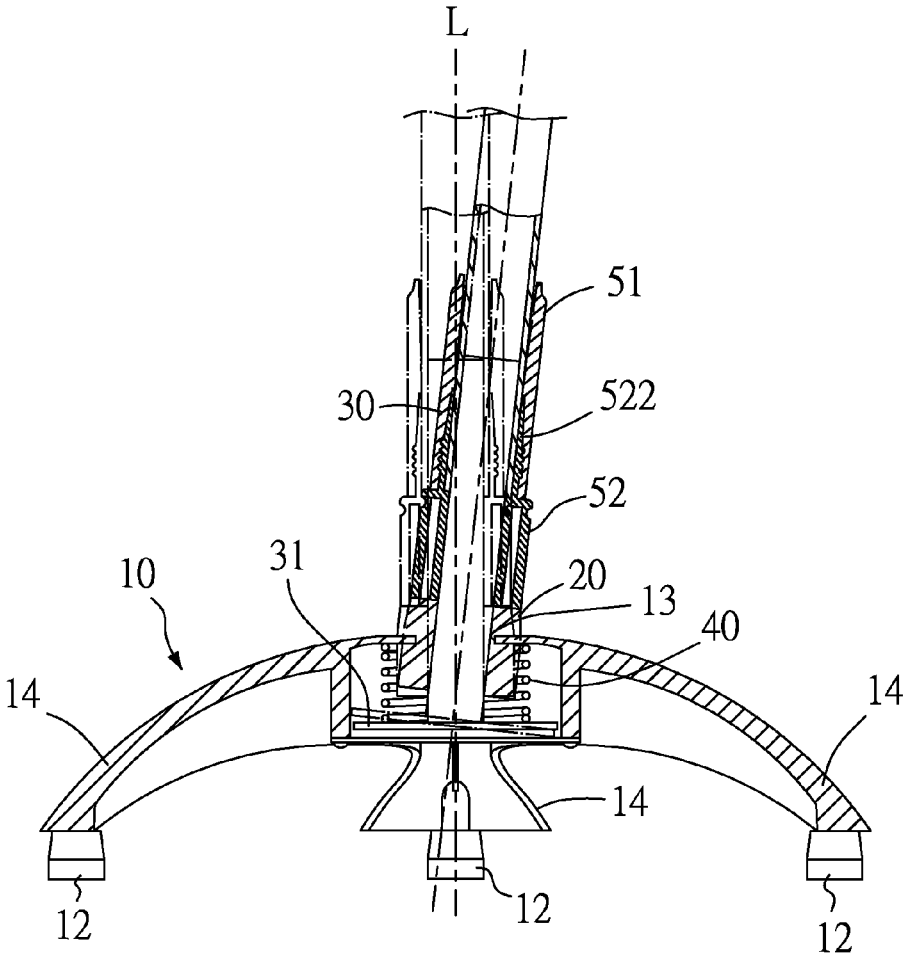
FIG. 3 shows the foot base for assistive device of the present invention has a support rod, which is adapted to conically swing relative to a base body of the foot base.

Please refer to FIGS. 1 to 3. A foot base 1 for assistive device according to a preferred embodiment of the present invention includes a base body 10, a flexible sleeve 20, a support rod 30 and a spring 40. The base body 10 includes a receiving space 11 and a plurality of foot pads 12 attached to a bottom of the base body 10. The base body 10 is provided on a top with an opening 13, which communicates with the receiving space 11. The flexible sleeve 20 is disposed in the receiving space 11 with an upper part protruded from the opening 13 of the base body 10. The support rod 30 has a lower end received in the receiving space 11 and provided with a stop plate 31, and an upper end extended through the flexible sleeve 20. The spring 40 is received in the receiving space 11 and fitted around the flexible sleeve 20, such that two opposite ends of the spring 40 are pressed against the stop plate 31 and an edge of the opening 13, respectively.

The base body 10 includes four radially outward extended prongs 14, which are symmetrically arranged relative to the receiving space 11 and respectively have one of the foot pads 12 attached to a bottom thereof for the base body 10 to stably stand on the ground. The foot pads 12 can be made of a rubber material to provide anti-skidding and shock-absorbing effects. The prongs 14 and the foot pads 12 are the same in number, which are not limited to four as illustrated in the preferred embodiment but can be increased or decreased according to actual need in use.

The receiving space 11 is a chamber defined between the bottom plate 15 and inner wall surfaces of a central bore of the base body 10. The bottom plate 15 is fixedly connected to a lower end of the central bore of the base body 10 via a plurality of screws 16, and the opening 13 is located at an upper end of the central bore of the base body 10. The flexible sleeve 20 is received in the receiving space 11 to be tightly fitted in the opening 13. The flexible sleeve 20 has an inner diameter corresponding to an outer diameter of the support rod 30, so as to tightly fit around the support rod 30. The spring 40 is fitted around the flexible sleeve 20 to press two opposite end against the stop plate 31 and the edge of the opening 13.

Referring to FIGS. 2 and 3. After the foot base 1 is fully assembled, the support rod 30 is located at a central position of the whole foot base 1. When it is not subjected to any external force, the support rod 30 is in an upright state to align with a centerline L of the foot base 1, as shown in FIG. 2. However, with the flexibility of the flexible sleeve 20 and the elasticity of the spring 40, the support rod 30 extended through the flexible sleeve 20 is adapted to conically swing relative to the centerline L when it is subjected to an external force. And, when the external force is removed, the support rod 30 can restore to the upright state aligned with the centerline L.

The foot base 1 according to the preferred embodiment of the present invention is designed for assembling to a lower end of an assistive device 2, so as to assist a user in standing and walking stably. The assistive device 2 is connected at the lower end with the support rod 30 of the foot base 1. With the flexibility of the flexible sleeve 20 and the elasticity of the spring 40, the support rod 30 is adapted to conically swing relative to the centerline L. This design advantageously allows the assistive device 2 to swing forward and backward in response to shift of the user's body gravity center when the user walks with the aid of the assistive device 2. Further, with the foot pads 12 attached to the bottom of the base body 10, the foot base 1 in use also provides anti-skidding, buffering and shock-absorbing effects.

The support rod 30 of the foot base 1 can be held to the lower end of the assistive device 2 by different manners, including, but not limited to, screwing, welding, integral forming or other suitable ways.

Figure 4:
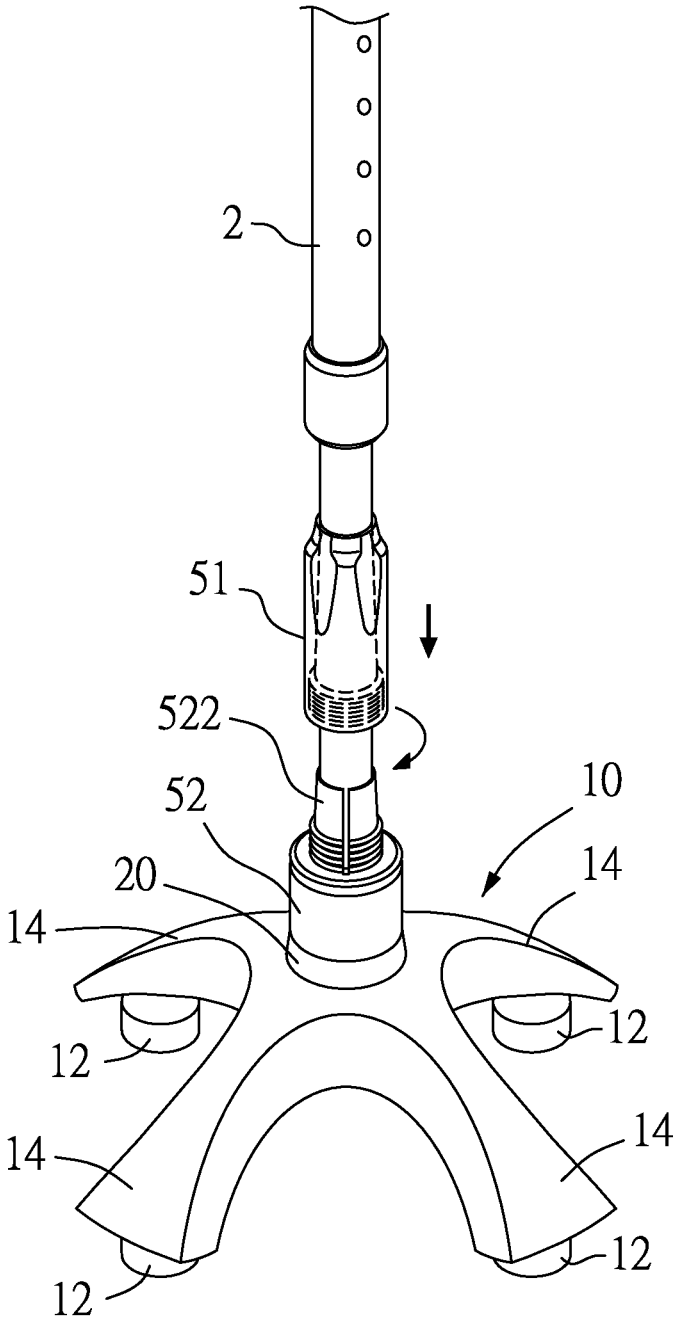
FIG. 4 shows the manner of assembling the foot base of the present invention to a lower end of an assistive device.
Figure 5:
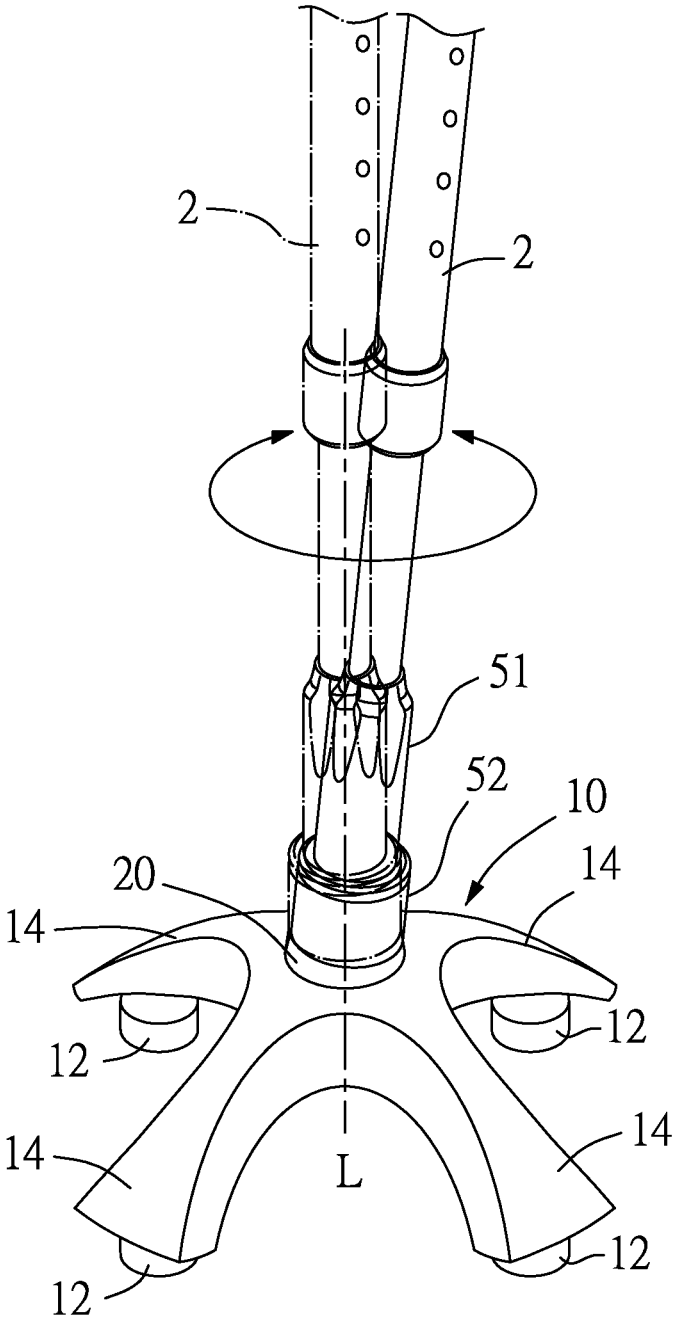
FIG. 5 shows the assistive device assembled to the foot base of the present invention is adapted to conically swing during use.

For example, the foot base 1 may include an all-purpose sleeve 51, and a sleeve seat 52. The all-purpose sleeve 51 and the sleeve seat 52 are correspondingly provided with internal threads 511 and external threads 521, respectively. The sleeve seat 52 is disposed on a top of the flexible sleeve 20 and fitted around the support rod 30. The sleeve seat 52 and the support rod 30 are correspondingly provided with threaded holes, through which a bolt 53 can be extended to fixedly hold the sleeve seat 52 and the support rod 30 to each other. Alternatively, the sleeve seat 52 and the support rod 30 can be held to each other through compression. The all-purpose sleeve 51 is fitted around the lower end of the assistive device 2. As can be best seen in FIGS. 4 and 5, the all-purpose sleeve 51 is firstly fitted around the assistive device 2 at a position near the lower end of the assistive device 2. Then, the support rod 30 located in the sleeve seat 52 is inserted into a lower open end of the all-purpose sleeve 51, and the all-purpose sleeve 51 is turned to screw onto the sleeve seat 52, so that the all-purpose sleeve 51 and the sleeve seat 52 together tightly hold the assistive device 2 in place atop the foot base 1. In the illustrated preferred embodiment, the sleeve seat 52 includes a chuck tube portion 522, on which a plurality of axially extended slits 523 are circumferentially equally spaced, and the aforesaid external threads 521 are formed an outer surface of the chuck tube portion 522. The all-purpose sleeve 51 has a bore tapered from an end with the internal threads 511 toward another opposite end. When the all-purpose sleeve 51 is screwed onto the sleeve seat 52, the chuck tube portion 522 is radially inward compressed by the all-purpose sleeve 51 to thereby firmly clamp on the assistive device 2.

With the all-purpose sleeve 51 and the sleeve seat 52, the foot base 1 of the present invention can be assembled to assistive devices 2 of various types and sizes.

In brief, the foot base 1 according to the preferred embodiment of the present invention is characterized by having the flexible sleeve 20, the support rod 30 and the spring 40 mounted in the receiving space 11 of the base body 10. The support rod 30 is extended through the flexible sleeve 20 and the spring 40 is fitted around the flexible sleeve 20. With the flexibility of the flexible sleeve 20 and the elasticity of the spring 40, the support rod 30 is allowed to conically swing relative to the centerline L of the foot base 1. This design advantageously allows the assistive device 2 gripped by the user to swing forward and backward in response to shifting of the user's body gravity center when the user walks with the aid of the assistive device 2. Further, with the foot pads 12 attached to the bottom of the base body 10, the foot base 1 in use also provides anti-skidding, buffering and shock-absorbing effects.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A foot base for assembling to a lower end of an assistive device, comprising:

a base body including a receiving space and a plurality of foot pads attached to a bottom of the base body; and the base body being provided on a top with an opening, which communicates with the receiving space;

a flexible sleeve being disposed in the receiving space with an upper part protruded from the opening of the base body;

a support rod having a lower end received in the receiving space and provided with a stop plate, and an upper end extended through the flexible sleeve for joining with the lower end of the assistive device; and a spring being received in the receiving space and fitted around the flexible sleeve, such that two opposite ends of the spring are pressed against the stop plate and an edge of the opening, respectively.

2. The foot base as claimed in claim 1, further comprising an all-purpose sleeve and a sleeve seat; the all-purpose sleeve and the sleeve seat being correspondingly provided with internal threads and external threads, respectively; the sleeve seat being disposed on a top of the flexible sleeve and fitted around the support rod; and the all-purpose sleeve being fitted around the lower end of the assistive device.

3. The foot base as claimed in claim 2, wherein the base body includes a plurality of radially outward extended prongs; and the prongs respectively having one of the foot pads attached to a bottom thereof.

4. The foot base as claimed in claim 3, wherein both of the prongs and the foot pads are four in number.

5. The foot base as claimed in claim 2, wherein the sleeve seat includes a chuck tube portion, on an outer surface of which a plurality of axially extended and circumferentially equally spaced slits and the external threads of the sleeve seat are formed; and wherein the all-purpose sleeve has a bore tapered from an end with the internal threads toward another opposite end; whereby when the all-purpose sleeve is screwed onto the sleeve seat, the chuck tube portion is radially inward compressed by the all-purpose sleeve to thereby firmly clamp on the assistive device.

6. The foot base as claimed in claim 5, wherein the base body includes a plurality of radially outward extended prongs; and the prongs respectively having one of the foot pads attached to a bottom thereof.

7. The foot base as claimed in claim 6, wherein both of the prongs and the foot pads are four in number.

8. The foot base as claimed in claim 1, wherein the base body includes a plurality of radially outward extended prongs; and the prongs respectively having one of the foot pads attached to a bottom thereof.

9. The foot base as claimed in claim 8, wherein both of the prongs and the foot pads are four in number.

* * * * *